US011577374B2

(12) United States Patent
Wang

(10) Patent No.: US 11,577,374 B2
(45) Date of Patent: Feb. 14, 2023

(54) LABOR-SAVING STAPLER

(71) Applicant: APEX MFG. CO., LTD., Taichung (TW)

(72) Inventor: Jing-Li Wang, Taichung (TW)

(73) Assignee: APEX MFG. CO., LTD., Taichung (TW)

( * ) Notice: Subject to any disclaimer, the term of this patent is extended or adjusted under 35 U.S.C. 154(b) by 77 days.

(21) Appl. No.: 17/210,123

(22) Filed: Mar. 23, 2021

(65) Prior Publication Data

US 2021/0205971 A1 Jul. 8, 2021

Related U.S. Application Data

(63) Continuation-in-part of application No. 16/378,319, filed on Apr. 8, 2019, now Pat. No. 11,065,751, which is a continuation-in-part of application No. 15/074,369, filed on Mar. 18, 2016, now abandoned.

(51) Int. Cl.
*B25C 5/06* (2006.01)
*B25C 5/11* (2006.01)

(52) U.S. Cl.
CPC . *B25C 5/06* (2013.01); *B25C 5/11* (2013.01)

(58) Field of Classification Search
CPC ..... B25C 5/11; B25C 5/06; B25C 5/0285
See application file for complete search history.

(56) References Cited

U.S. PATENT DOCUMENTS 2,493,640 A * 1/1950 Peterson ..... B25C 5/10 227/132
3,913,817 A * 10/1975 Barrett ..... B25C 1/02 227/126
4,126,260 A * 11/1978 Mickelsson ..... B25C 5/10 227/132
4,156,499 A * 5/1979 Frank ..... B25C 5/16 227/132

(Continued)

FOREIGN PATENT DOCUMENTS

CH 255111 A * 6/1948 ..... B25C 5/085
TW 133628 B 1/2011

*Primary Examiner* — Thomas M Wittenschlaeger
*Assistant Examiner* — Katie L Gerth
(74) *Attorney, Agent, or Firm* — Muncy, Geissler, Olds & Lowe, P C.

(57) ABSTRACT

A labor-saving stapler is provided, including: a housing, having a nail outlet; a striker, disposed within the housing and movable between a preset position away from the nail outlet and a nailing position near the nail outlet; an energy-accumulating mechanism, including a connection portion connected to the housing and a connection end cooperating with the striker; an operable mechanism, movably connected to the housing and having a depression portion abutable against the energy-accumulating mechanism; a limitation mechanism, connected to the housing, the striker being positionably restricted by the limitation mechanism; wherein when the striker is in a preset position and positionably restricted by the limitation mechanism, the energy-accumulating mechanism is depressible by the depression portion to be in a energy-accumulating state, and when the (Continued)

striker is free of restriction by the limitation mechanism, the energy-accumulating mechanism actuates the striker to move toward the nailing position.

11 Claims, 5 Drawing Sheets

(56) References Cited

U.S. PATENT DOCUMENTS 5,328,075 A * 7/1994 Marks ..... B25C 5/11 227/132
5,335,839 A * 8/1994 Fealey ..... B25C 5/06 227/132
5,407,118 A * 4/1995 Marks ..... B25C 5/085 227/132
5,497,932 A * 3/1996 Brewer ..... B25C 5/11 227/132
5,511,716 A * 4/1996 Marks ..... B25C 5/085 227/132
5,664,722 A * 9/1997 Marks ..... B25C 5/085 227/132
5,664,772 A 9/1997 Auerbach et al.
5,699,949 A * 12/1997 Marks ..... B25C 5/11 227/132
5,816,470 A * 10/1998 Plato ..... B25C 5/11 227/132
5,967,397 A * 10/1999 Fealey ..... B25C 5/1644 227/120
5,979,736 A * 11/1999 Edeholt ..... B25C 5/11 227/132
6,789,719 B2 * 9/2004 Shor ..... B25C 5/11 227/120
7,299,960 B1 * 11/2007 Marks ..... B25C 5/025 227/132
8,276,799 B2 * 10/2012 Chen ..... B25C 5/0242 227/129
9,296,098 B2 * 3/2016 Wang ..... B25C 5/11
9,643,308 B2 * 5/2017 Ebbesson ..... B25C 5/11
2004/0084504 A1 * 5/2004 Shor ..... B25C 5/11 227/132
2007/0257080 A1 * 11/2007 Kamins ..... B25C 5/10 29/798
2008/0156844 A1 * 7/2008 Braganza ..... B25C 5/06 227/120
2008/0223902 A1 * 9/2008 Tsai ..... B25C 5/11 227/134
2008/0290133 A1 * 11/2008 Shor ..... B25C 5/10 227/132
2009/0120991 A1 * 5/2009 Chen ..... B25C 5/11 227/8
2010/0187279 A1 * 7/2010 Lin ..... B25C 5/0257 227/8
2011/0297725 A1 * 12/2011 Huang ..... B25C 5/11 227/140
2012/0181320 A1 * 7/2012 Wang ..... B25C 5/1658 227/109
2013/0133906 A1 * 5/2013 Huang ..... B25C 5/11 173/18
2013/0228604 A1 * 9/2013 Wang ..... B25C 5/06 227/8
2013/0228605 A1 * 9/2013 Wang ..... B25C 5/11 227/8
2014/0231486 A1 * 8/2014 Burch ..... B25C 5/0285 227/63
2015/0041516 A1 * 2/2015 Chen ..... B25C 5/11 227/107
2016/0059400 A1 * 3/2016 Wang ..... B25C 5/06 227/8

* cited by examiner

LABOR-SAVING STAPLER

The present invention is a CIP of application Ser. No. 16/378,319, filed Apr. 8, 2019, which is a CIP of application Ser. No. 15/074,369, filed Mar. 18, 2016, the entire contents of which are hereby incorporated by reference.

BACKGROUND OF THE INVENTION

Field of the Invention

Description of the Prior Art

Usually, in a conventional stapler, as disclosed in TWI336286 and U.S. Pat. No. 6,789,719, a grip portion swings to actuate a connection rod in the stapler to swing so as to move a striker which slides straightly to a position to be struck. In the meanwhile, the striker is abutted against by a spring or an elastic sheet, when the striker moves toward the position to be struck, the elastic sheet is bent to accumulate energy; and when the connection rod swings to separate from the striker, the striker is bounded by the elastic member to move downward quickly to strike a nail.

In actual use, this type of stapler has a more complex structure, and it is more labor-consuming to use the stapler. Firstly, the stapler releases the striker through the connection rod which swings to move and the striker which moves straightly separating from each other automatically. When the connection rod is abraded due to long-term use, the striker may be released earlier, the elastic sheet may not be fully functioned, and the nail may not be struck precisely. Secondly, if the striker and the connection rod change positions slightly due to an error during production or being hit by a force, the striker may be released in different timings, and the striker may be non-releasable or be released earlier.

In addition, when the stapler is out of use, the striker remains in a position after striking and continues to contact the nail in the stapler. After the striker is actuated by the connection rod to move, the nail moves forward to a correct position to strike the nail smoothly. If a user uses the stapler continuously and quickly, the striker tends to strike downward before the nail moves to the correct position; therefore, the nail is squeezed abnormally to block an outlet of the nail and cause damage.

U.S. Pat. No. 5,664,722 discloses that the depression portion (or the part of the housing abutted against the portion of the spring) and the energy-accumulating mechanism are in a fixed position and do not move up and down relative to the housing either in the energy-accumulating state or releasing state. As the tab of the lever serves as the depression portion, the tab is located at either of opposite sides of the spring in energy-accumulating state or releasing state since protrusion of the housing should force lever to slide sidewards because of the contact between protrusion and angled tab so that it forces lever to slide out from under section of spring. This can cause abrasion, damage and deformation of lever, spring and protrusion of the housing, and unstable of force of the spring for striker. Furthermore, the striker is near the nail outlet when the energy-accumulating mechanism is in the releasing state, which can affect the staples due to contact of the striker with the staples as the striker is raised.

The present invention has arisen to mitigate and/or obviate the afore-described disadvantages.

SUMMARY OF THE INVENTION

The major object of the present invention is to provide a labor-saving stapler which is labor-saving and can increase energy accumulated to make operation more convenient.

To achieve the above and other objects, a labor-saving stapler is provided, including: a housing, having a nail outlet; a striker, disposed within the housing and movable between a preset position away from the nail outlet and a nailing position near the nail outlet; an energy-accumulating mechanism, including a connection portion connected to the housing and a connection end cooperating with the striker, being deformable to be in an energy-accumulating state or a releasing state; an operable mechanism, movably connected to the housing and having a depression portion abutable against the energy-accumulating mechanism between the connection portion and the connection end; a limitation mechanism, connected to the housing, the striker being positionably restricted by the limitation mechanism; wherein when the striker is in the preset position and positionably restricted by the limitation mechanism, the energy-accumulating mechanism is depressible by the depression portion of the operable mechanism to be in the energy-accumulating state, and when the striker is free of restriction by the limitation mechanism, the energy-accumulating mechanism actuates the striker to move toward the nailing position.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
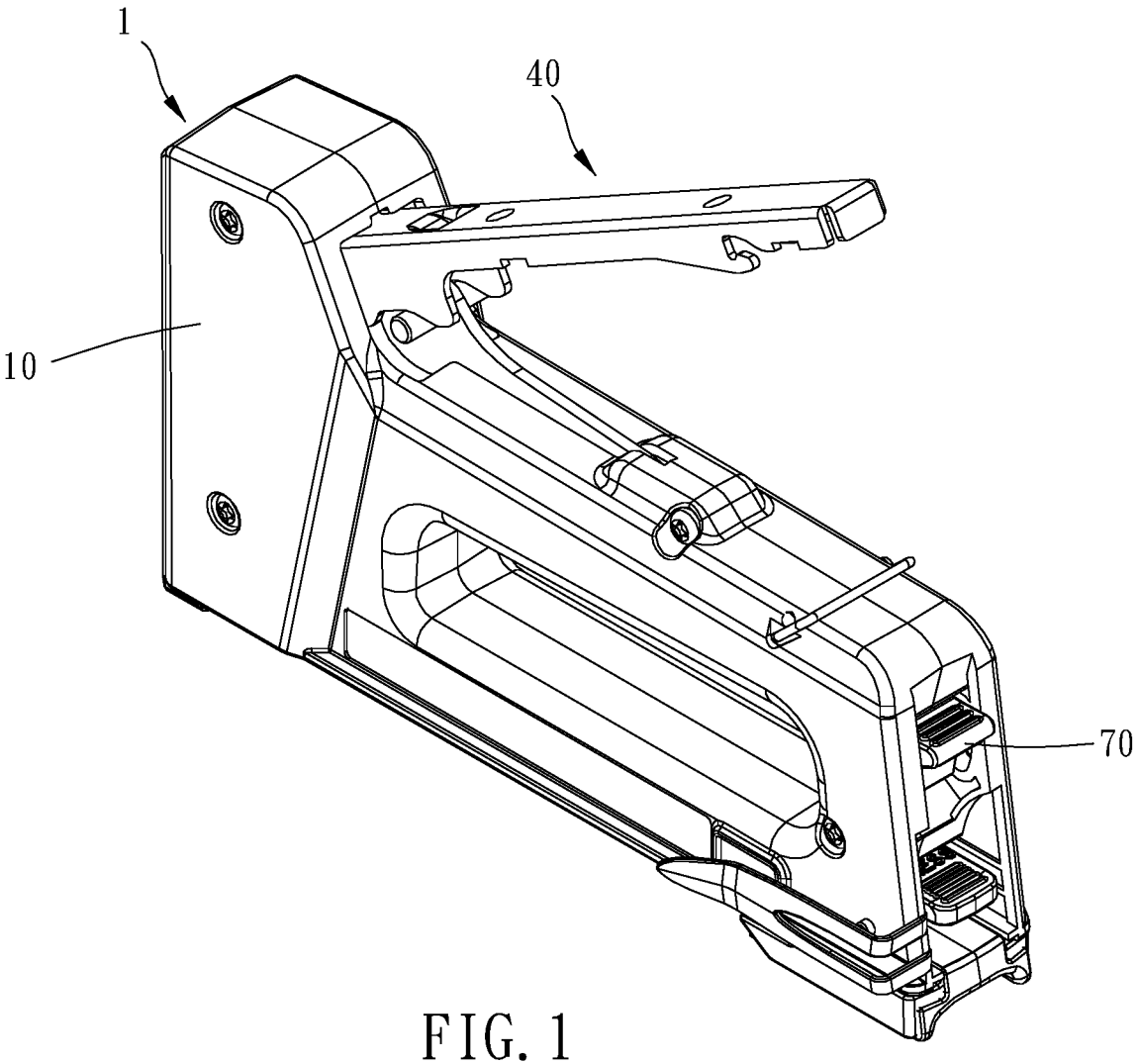
FIG. 1 is a perspective view of a preferred embodiment of the present invention.
Figure 2:
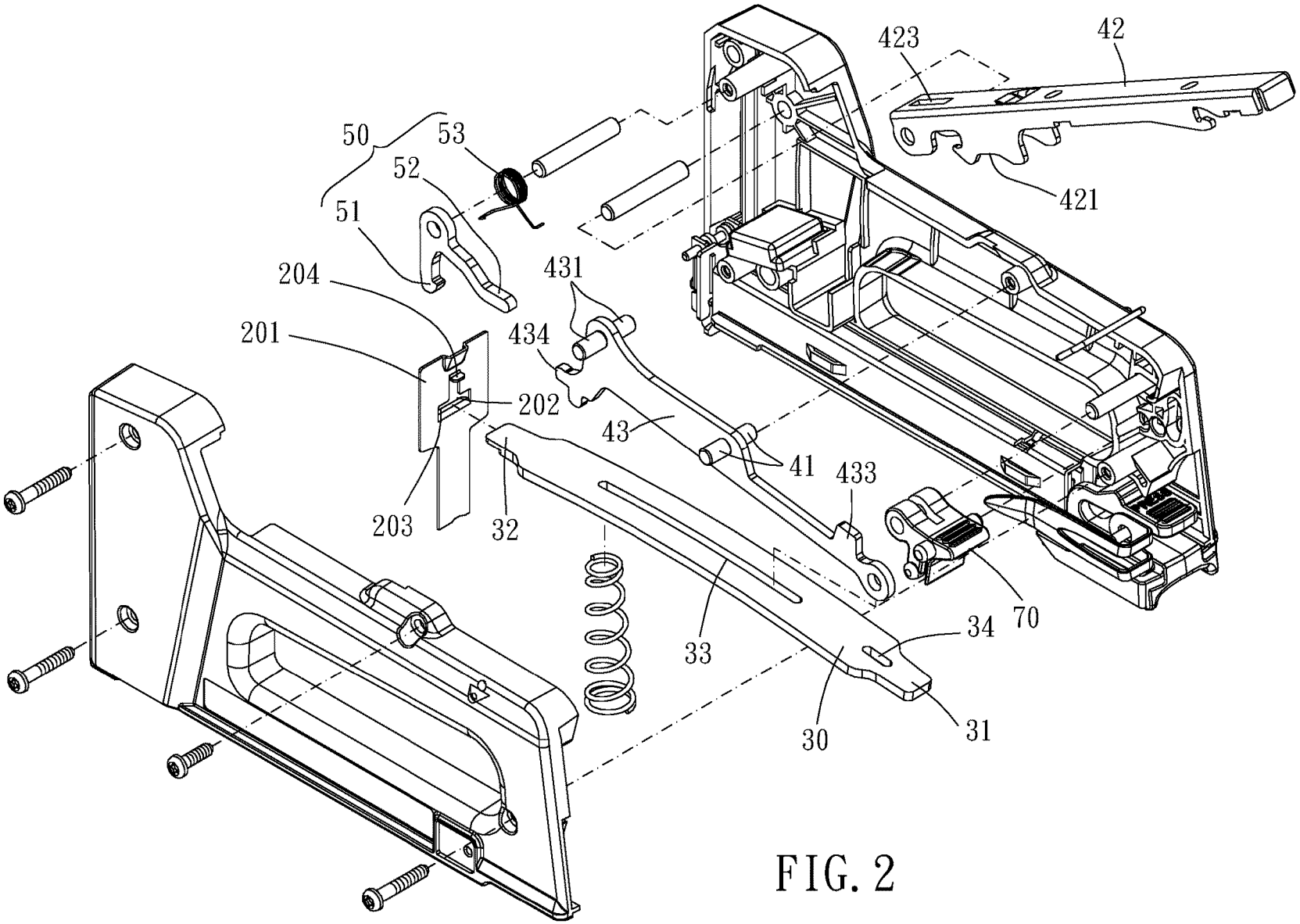
FIG. 2 is a breakdown view of the preferred embodiment of the present invention.

The present invention will be clearer from the following description when viewed together with the accompanying drawings, which show, for purpose of illustrations only, the preferred embodiment in accordance with the present invention.

Please refer to FIGS. 1 to 5 for a preferred embodiment of the present invention. A labor-saving stapler 1 includes a housing 10, a striker 20, an energy-accumulating mechanism 30, an operable mechanism 40 and a limitation mechanism 50.

Figure 3:
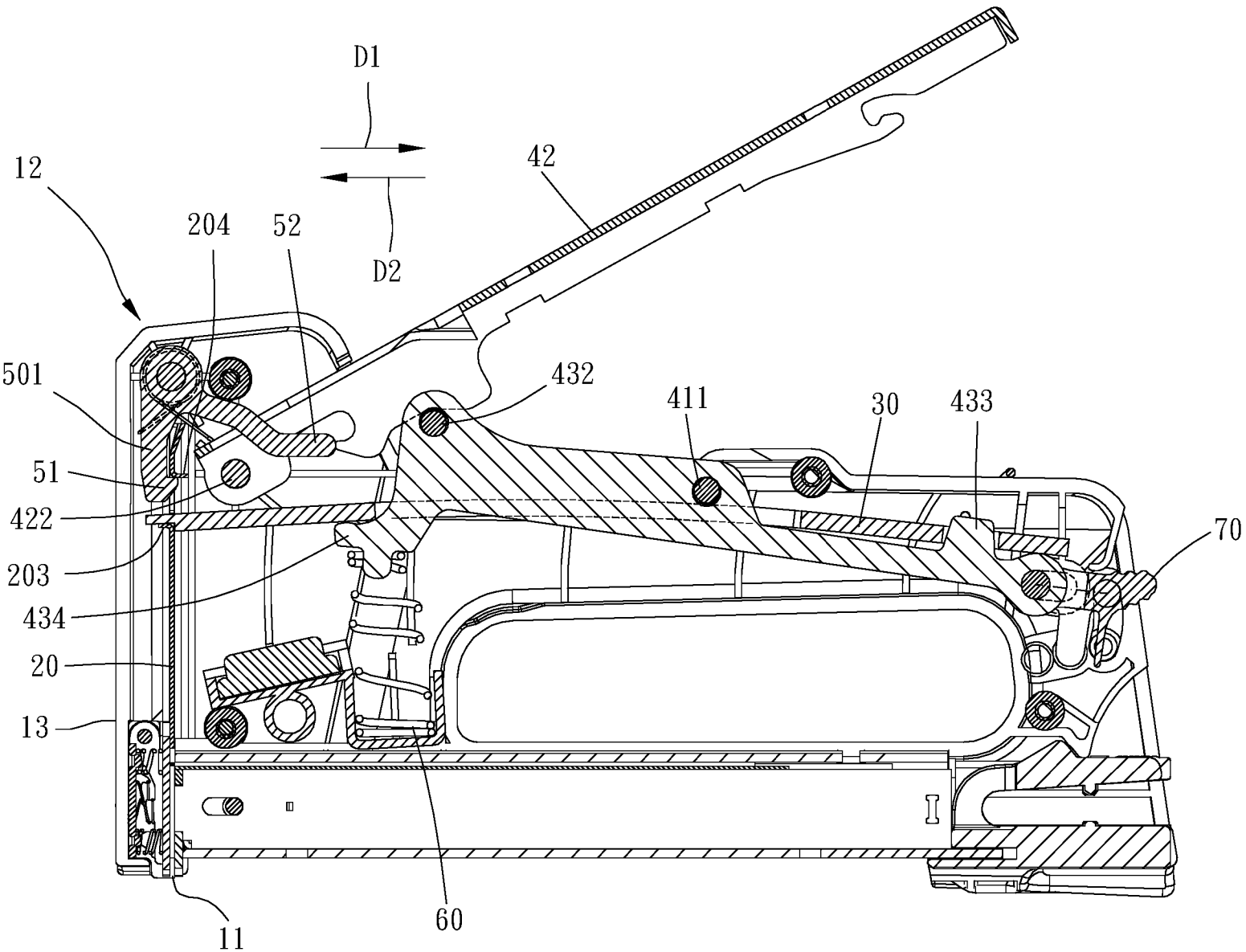
FIG. 3 is a cross-sectional view of the preferred embodiment of the present invention.
Figure 4:
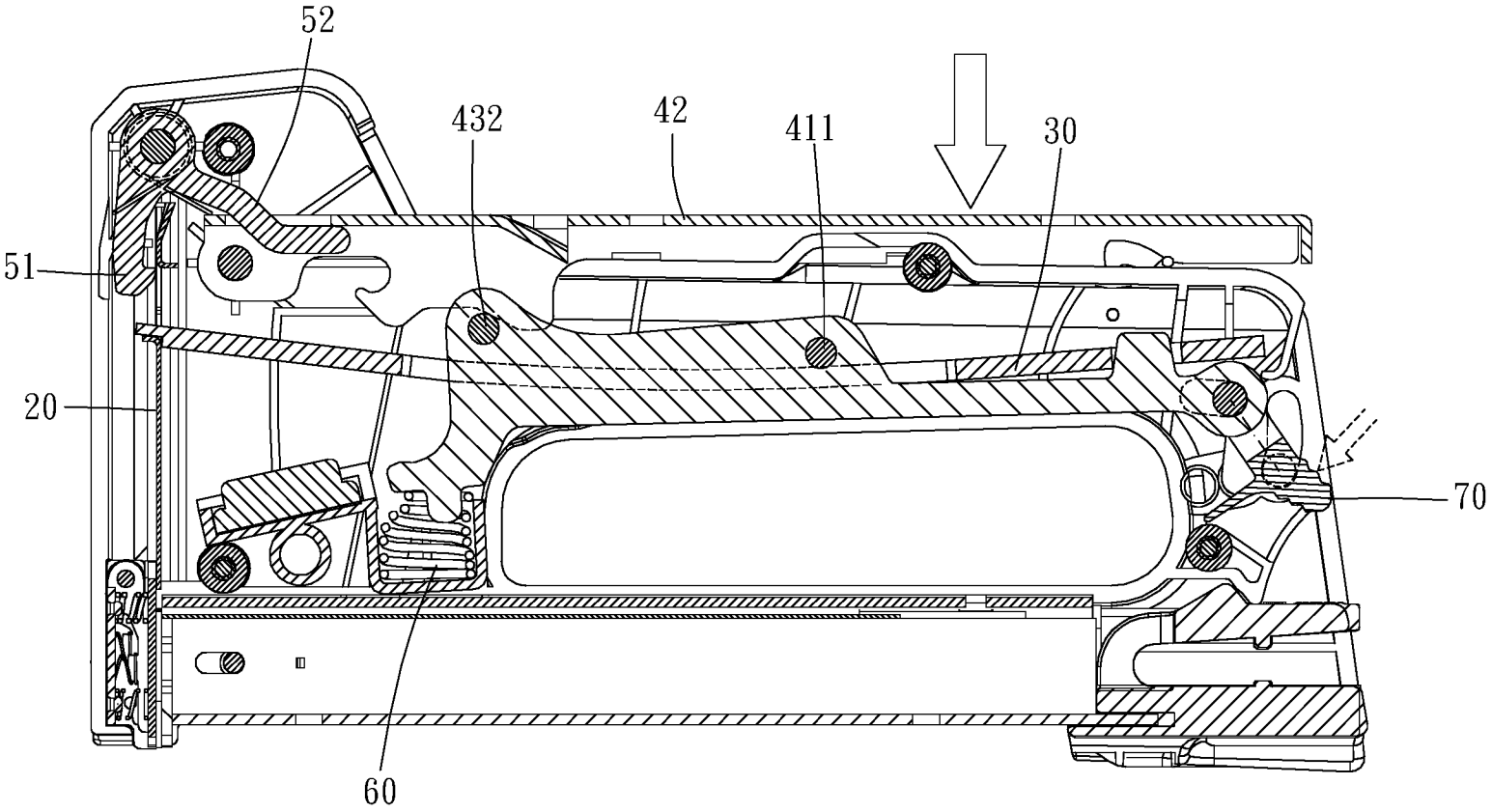
FIGS. 4 and 5 are drawings showing the preferred embodiment of the present invention in operation.
Figure 5:
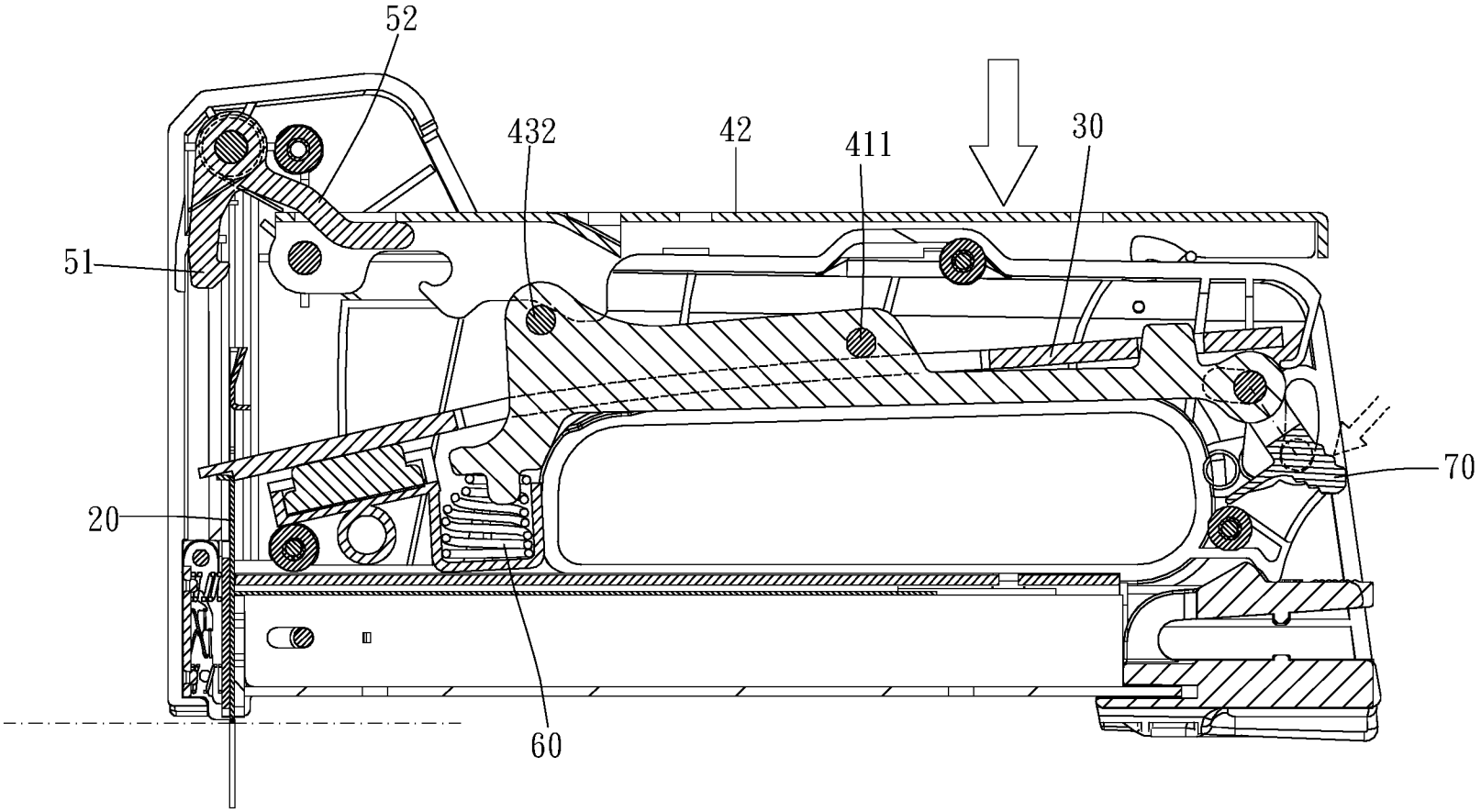

The housing 10 has a nail outlet 11. The striker 20 is disposed within the housing 10 and movable between a preset position distant from the nail outlet 11 and a nailing position near the nail outlet 11. The energy-accumulating mechanism 30 includes a connection portion 31 connected to the housing 10 and a connection end 32 cooperating with the striker 20, and the energy-accumulating mechanism 30 is deformable to be in an energy-accumulating state or a releasing state. The operable mechanism 40 is movably connected to the housing 10 and has a depression portion 41 abutable against the energy-accumulating mechanism 30 between the connection portion 31 and the connection end 32. The limitation mechanism 50 is connected to the housing 10, and the striker 20 is positionably restricted by the limitation mechanism 50. When the striker 20 is in the preset position and positionably restricted by the limitation mechanism 50 (as shown in FIG. 3), the energy-accumulating mechanism 30 is depressible by the depression portion 41 of the operable mechanism 40 to be in the energy-accumulating state (as shown in FIG. 4), and when the striker 20 is free of restriction by the limitation mechanism 50, the energy-accumulating mechanism 30 actuates the striker 20 to move toward the nailing position (as shown in FIG. 5). Through the depression portion 41 abutable against the energy-accumulating mechanism 30 between the connection portion 31 and the connection end 32, it is more labor-saving to make the energy-accumulating mechanism 30 deform. Preferably, when the striker 20 is in the preset position and positionably restricted by the limitation mechanism 50 and the operable mechanism 40 is not pressed, the depression portion 41 depresses the energy-accumulating mechanism 30 with a pre-pressure to produce a pre-deformation so as to increase a deformation of the energy-accumulating mechanism 30 to elevate a striking effect of the striker 20.

Specifically, the operable mechanism 40 further includes a lever 42 which is pivoted to a frontal end of the housing 10 and a connection rod 43 which is pivoted to a rear end of the housing 10 and abutable by the lever 42, and the connection rod 43 is provided with the depression portion 41. The energy-accumulating mechanism 30 includes an elongate through slot 33 along an axial direction which the frontal end and rear end of the housing 10 are located on, the connection rod 43 is disposed through the elongate through slot 33 and abuts against the energy-accumulating mechanism 30 via the depression portion 41, the connection rod 43 is further provided with a bearing portion 431 which is depressed by the lever 42, and the bearing portion 431 and the depression portion 41 are located on a same side and between the energy-accumulating mechanism 30 and the lever 42, and the lever 42 and the connection rod 43 are a two-section leverage mechanism so that it is more labor-saving to make the energy-accumulating mechanism 30 deform.

In this embodiment, the lever 42 includes a curved portion 421 facing the connection rod 43, the depression portion 41 includes at least one depression rod 411 lateral to the elongate through slot 33, the bearing portion 431 is away from the energy-accumulating mechanism 30 and includes at least one depressed rod 432 lateral to the elongate through slot 33, and the at least one depressed rod 432 is depressed by the curved portion 421 to actuate the at least one depression rod 411 to depress the energy-accumulating mechanism 30. Specifically, a rear end of the energy-accumulating mechanism 30 further includes a through slot 34, a rear end of the connection rod 43 further includes a slide protrusion 433 which protrudes upward and is disposed through the through slot 34, the energy-accumulating mechanism 30 may further include at least one metal elastic sheet or be formed by a plurality of elastic sheets piled up. The curved portion 421 protrudes gradually toward the connection rod 43 and gradually away from the nail outlet 11 to increase the deformation of the energy-accumulating mechanism 30. The connection rod 43 further includes a restriction protrusion 434, the restriction protrusion 434 and the bearing portion 431 are located on two opposite sides of the energy-accumulating mechanism 30, and the restriction protrusion 434 can block the energy-accumulating mechanism 30 along a pivoting direction toward the energy-accumulating mechanism 30. Specifically, the depression portion 41 includes two said depression rods 411 which extend toward opposite directions and are cylindrical, and the bearing portion 431 includes two said depressed rods 432 which extend toward opposite directions and are cylindrical so as to decrease friction and to average depression. However, numbers of the depression rod 411 and the depressed rod 432 are not limited, and the depression rod 411 and the depressed rod 432 may be a rolling member or other structures.

Preferably, a pivoting portion 422 of the lever 42 near the housing 10 further includes a through hole 423 (or an opening), the limitation mechanism 50 is pivoted to the housing 10 and includes a hook portion 51, an extension portion 52 and a spring 53, the hook portion 51 positionably restricts the striker 20, the extension portion 52 is inserted in the through hole 423, the spring 53 makes the hook portion 51 move toward the striker 20, and the extension portion 52 is actuated by the lever 42 to make the hook portion 51 disassembled from the striker 20. However, the limitation mechanism may not be co-movable with the lever or may be other types of triggering mechanisms.

Preferably, a repositionable elastic member 60 is arranged between the housing 10 and the energy-accumulating mechanism 30. The repositionable elastic member 60 can abut against and push the connection rod 43 and the energy-accumulating mechanism 30 upward to actuate the striker 20 to move to the preset position and be positionably restricted by the limitation mechanism 50. In this embodiment, the labor-saving stapler 1 further includes an adjustment mechanism 70 which is movably arranged in the housing 10 and connected to the connection rod 43, and a relative position of the connection rod 43 and the energy-accumulating mechanism 30 are changeable by moving the adjustment mechanism 70. For example, the slide protrusion 433 of the connection rod 43 is slidably disposed in the through slot 34 and is adjustable by the adjustment mechanism 70 to make the energy-accumulating mechanism 30 move and change a restriction state of the energy-accumulating mechanism 30 and the striker 20, or to control a combination state or an energy-accumulating ability of the connection rod 43 and the energy-accumulating mechanism 30.

The depression portion 41 and the energy-accumulating mechanism 30 are cooperatively movable up and down relative to the housing 10, and the depression portion 41 is always located above the energy-accumulating mechanism 30 and movable to press the energy-accumulating mechanism 30 downward. The striker 20 is retained in the preset position when the energy-accumulating mechanism 30 is depressed downward by the operable mechanism. When the striker is positionably restricted by the limitation mechanism and during the energy-accumulating mechanism 30 accumulates energy to be in the energy-accumulating state, the depression portion 41 moves down and depresses the energy-accumulating mechanism 30 downward, and the striker 20 and the connection end 32 keep in a fixed position distant from the nail outlet 11 until the striker is free of restriction by the limitation mechanism.

Specifically, the limitation mechanism 50 is rotatably connected to an upper portion 12 of a front end 13 of the housing 10 and further includes an engaging arm 501, the engaging arm 501 is located between the front end 13 of the housing 10 and the striker 20, the engaging arm 501 is inserted within an upper portion 201 of the striker 20 in a first direction D1 from the front end 13 of the housing 10 toward the striker 20 when the upper portion 201 of the striker 20 is positionably restricted by the engaging arm 501, the extension portion 52 is actuated by the lever 42 to make the engaging arm 501 disassembled from the striker 20, and the connection end 32 is inserted within the upper portion 201 of the striker 20 in a second direction D2 opposite to the first direction D1. The engaging arm 501 includes the hook portion 51. The striker 20 includes a through hole 202, a first tab 203 and a second tab 204, the first tab 203 and the second tab 204 are respectively located at opposite sides of the through hole 202 and oppositely extend laterally from the striker 20, the connection end 32 is abutted against the first tab 203, and the engaging arm 501 is abutted against the second tab 204.

In actual practice, the repositionable elastic member 60 pushes the connection rod 43 and the energy-accumulating mechanism 30 upward and actuates the striker 20 to move to the preset position to be positionably restricted by the hook portion 51 of the limitation mechanism 50, and the lever 42 is pressed to abut against the two depressed rods 432 via the curved portion 421 so that the two depression rods 411 abut against the energy-accumulating mechanism 30 to deform and accumulate energy. When the extension portion 52 is swung and rotated by the lever 42, and the hook portion 51 is disassembled from the striker 20, the elasticity of the energy-accumulating mechanism 30 actuates the striker 20 to strike toward the nail outlet 11. As the lever 42 is released, through the force of the repositionable elastic member 60, the lever 42 is repositioned in the preset position for a next operation.

Given the above, through the depression portion abutable against the energy-accumulating mechanism between the connection portion and the connection end, it is more labor-saving to make the energy-accumulating mechanism deform. In addition, when the operable mechanism is not pressed, the depression portion depresses the energy-accumulating mechanism with the pre-pressure to produce the pre-deformation so as to increase the deformation of the energy-accumulating mechanism to elevate the striking effect of the striker.

While we have shown and described various embodiments in accordance with the present invention, it should be clear to those skilled in the art that further embodiments may be made without departing from the scope of the present invention.

What is claimed is:

1. A labor-saving stapler, including:

a housing, having a nail outlet;

a striker, disposed within the housing and movable between a preset position distant from the nail outlet and a nailing position near the nail outlet;

an energy-accumulating mechanism, including a connection portion connected to the housing and a connection end cooperating with the striker, being deformable to be in an energy-accumulating state or a releasing state;

an operable mechanism, movably connected to the housing and having a depression portion abutable against the energy-accumulating mechanism between the connection portion and the connection end;

a limitation mechanism, connected to the housing, the striker being positionably restricted by the limitation mechanism;

wherein when the striker is in the preset position and positionably restricted by the limitation mechanism, the energy-accumulating mechanism is depressible by the depression portion of the operable mechanism to be in the energy-accumulating state, and when the striker is free of restriction by the limitation mechanism, the energy-accumulating mechanism actuates the striker to move toward the nailing position;

wherein the depression portion and the energy-accumulating mechanism are cooperatively movable up and down relative to the housing, and the depression portion is always located above the energy-accumulating mechanism and movable to press the energy-accumulating mechanism downward;

wherein the striker is retained in the preset position when the energy-accumulating mechanism is depressed downward by the operable mechanism;

wherein when the striker is positionably restricted by the limitation mechanism and during the energy-accumulating mechanism accumulates energy to be in the energy-accumulating state, the depression portion moves down and depresses the energy-accumulating mechanism downward, and the striker and the connection end is retained in the preset position distant from the nail outlet until the striker is free of restriction by the limitation mechanism;

wherein the operable mechanism includes a lever which is pivoted to the housing, the limitation mechanism is rotatably connected to an upper portion of a front end of the housing and includes an engaging arm and an extension portion, the lever includes a through hole located inside the upper portion of the front end of the housing, the extension portion is located inside and entirely covered by the upper portion of the front end of the housing and inserted within the through hole, the engaging arm is located between the front end of the housing and the striker and the engaging arm is inserted within an upper portion of the striker in a first direction from the front end of the housing toward the striker when the upper portion of the striker is positionably restricted by the engaging arm, the extension portion is actuated by the lever to make the engaging arm disassembled from the striker, and the connection end is inserted within the upper portion of the striker in a second direction opposite to the first direction.

2. The labor-saving stapler of claim 1, wherein when the striker is in the preset position and the striker is positionably restricted by the limitation mechanism, and the operable mechanism is not pressed, the depression portion abuts against the energy-accumulating mechanism with a pre-pressure to produce a pre-deformation.

3. The labor-saving stapler of claim 1, wherein the operable mechanism further includes a connection rod which is pivoted to the housing and depressed by the lever, and the connection rod is provided with the depression portion.

4. The labor-saving stapler of claim 3, wherein the energy-accumulating mechanism includes an elongate through slot, the connection rod is disposed through the elongate through slot and abuts against the energy-accumulating mechanism via the depression portion, the connection rod is further provided with a bearing portion which is depressed by the lever, and the bearing portion and the depression portion are located on a same side and between the energy-accumulating mechanism and the lever.

5. The labor-saving stapler of claim 4, wherein the lever includes a curved portion facing the connection rod, the depression portion includes at least one depression rod lateral to the elongate through slot, the bearing portion is away from the energy-accumulating mechanism and includes at least one bearing rod lateral to the elongate through slot, and the at least one bearing rod is depressed by the curved portion to actuate the at least one depression rod to depress the energy-accumulating mechanism.

6. The labor-saving stapler of claim 5, wherein the curved portion protrudes gradually toward the connection rod and gradually away from the nail outlet.

7. The labor-saving stapler of claim 3, wherein the limitation mechanism is pivoted to the housing, the engaging arm includes a hook portion, the hook portion positionably restricts the striker, the extension portion is inserted in the through hole, and the extension portion is actuated by the lever to make the hook portion disassembled from the striker.

8. The labor-saving stapler of claim 3, wherein the connection rod further includes a restriction protrusion, the restriction protrusion and the bearing portion are located on two opposite sides of the energy-accumulating mechanism, and the restriction protrusion is capable of blocking the energy-accumulating mechanism along a pivoting direction toward the energy-accumulating mechanism.

9. The labor-saving stapler of claim 3, further including an adjustment mechanism which is movably arranged in the housing and connected to the connection rod, a relative position of the connection rod and the energy-accumulating mechanism being changeable by moving the adjustment mechanism.

10. The labor-saving stapler of claim 1, wherein a repositionable elastic member is arranged between the housing and the energy-accumulating mechanism.

11. The labor-saving stapler of claim 1, wherein the striker includes a through hole, a first tab and a second tab, the first tab and the second tab are respectively located at opposite sides of the through hole of the striker and oppositely extend laterally from the striker, the connection end is abutted against the first tab, and the engaging arm is abutted against the second tab.

* * * * *